US010139190B1

(12) United States Patent
Trpkovski

(10) Patent No.: US 10,139,190 B1
(45) Date of Patent: Nov. 27, 2018

(54) CROSSBOW WITH TAKE-APART STOCK

(71) Applicant: P.T. Archery LLC, Prairie du Sac, WI (US)

(72) Inventor: Paul Trpkovski, Kailua Kona, HI (US)

(73) Assignee: P.T. Archery LLC, Prairie du Sac, WI (US)

( * ) Notice: Subject to any disclaimer, the term of this patent is extended or adjusted under 35 U.S.C. 154(b) by 0 days.

(21) Appl. No.: 15/863,007

(22) Filed: Jan. 5, 2018

Related U.S. Application Data

(60) Provisional application No. 62/511,881, filed on May 26, 2017.

(51) Int. Cl.
*F41B 5/12* (2006.01)

(52) U.S. Cl.
CPC ..... *F41B 5/123* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 4,002,236 A * 1/1977 Tolleson ..... A45C 11/24 124/25
4,942,861 A * 7/1990 Bozek ..... F41B 5/12 124/25
5,209,215 A * 5/1993 Morrison ..... F41B 5/12 124/22
5,522,373 A * 6/1996 Barnett ..... F41B 5/12 124/23.1
5,749,348 A * 5/1998 Oviedo-Reyes ..... F41B 5/12 124/25
8,622,050 B2 1/2014 Goff et al.
9,140,513 B2 9/2015 Trpkovski
9,568,269 B1 * 2/2017 Chang ..... F41B 5/12
2016/0169612 A1 6/2016 Kim
2016/0252320 A1 9/2016 Kinmont, Jr.
2018/0172394 A1 6/2018 Trpkovski

OTHER PUBLICATIONS

"Draw-Loc Product Webpage," http://www.drawloc.com/drawloc, retrieved Jan. 15, 2017 (5 pages).
"Non-Final Office Action," for U.S. Appl. No. 15/845,603 dated Jun. 14, 2018 (11 pages).
"Response to Non Final Office Action," for U.S. Appl. No. 15/845,603, filed Aug. 22, 2018 (7 pages).

* cited by examiner

*Primary Examiner* — John Ricci
(74) *Attorney, Agent, or Firm* — Pauly, DeVries Smith & Deffner LLC

(57) ABSTRACT

An embodiment provides a crossbow, comprising a stock and a bow portion. The stock comprises a first portion and a second portion. The first portion comprises a string latch and extends from a rear end to a coupling end. The second portion extends from a coupling end to a front end. The bow portion comprises a riser assembly, a first limb coupled to the riser assembly, a second limb coupled to the riser assembly; and a drawstring extending from a distal end of the first limb to a distal end of the second limb. The bow portion is coupled to the second portion of the stock. The coupling end of the first portion of the stock is detachably coupled to the coupling end of the second portion of the stock at a coupling location. The coupling location is between the string latch and the drawstring in an undrawn position.

20 Claims, 6 Drawing Sheets

CROSSBOW WITH TAKE-APART STOCK

CLAIM OF PRIORITY

This application claims the benefit of U.S. Provisional Application No. 62/511,881, filed May 26, 2017, the content of which is herein incorporate by reference in its entirety.

FIELD OF THE TECHNOLOGY

The present application relates to a stock for a crossbow. More specifically, the present application relates to two part stock for a crossbow.

BACKGROUND

Crossbows have been in use for hundreds of years. People frequently travel over long distance with a crossbow, such as while hunting. Therefore, there is a need for a crossbow that can be easily transported without decreasing the power or structural integrity of the cross bow.

SUMMARY

An embodiment provides a crossbow comprising a stock and a bow portion. The stock comprising a first portion and a second portion. The first portion comprises a string latch and the first portion extends from a rear end to a coupling end. The second portion extends from a coupling end to a front end. The bow portion comprising a riser assembly, a first limb coupled to the riser assembly, a second limb coupled to the riser assembly, and a drawstring extending from a distal end of the first limb to a distal end of the second limb. The bow portion is coupled to the second portion of the stock. The coupling end of the first portion of the stock is detachably coupled to the coupling end of the second portion of the stock at a coupling location. The coupling location is between the string latch and the drawstring in an undrawn position.

In some embodiments, first portion further comprises a trigger element between the string latch and the drawstring in an undrawn position and wherein the coupling location is between the trigger element and the drawstring in an undrawn position.

In some embodiments, the distance from the distal end of the first limb to the distal end of the second limb is within 9 inches of the distance from the rear end of the first portion to the coupling end of the first portion.

In some embodiments, the distance from the distal end of the first limb to the distal end of the second limb is within 5 inches of the distance from the rear end of the first portion to the coupling end of the first portion.

In some embodiments, the distance from the distal end of the first limb to the distal end of the second limb is greater than or equal to the distance from the coupling end of the second portion to the front end of the second portion.

In some embodiments, one of the coupling ends defines a female dovetail coupling and the other coupling end defines a male dovetail coupling.

In some embodiments, the bow portion further comprises a power cable extending from the distal end of the first limb to the distal end of the second limb; and the power cable is retained by the second portion of the stock.

In some embodiments, the bow portion is arranged on the stock in a horizontal configuration.

In some embodiments, the stock comprises two parallel plates defining a gap.

An embodiment provides a crossbow comprising a stock and a bow portion. The stock comprising a first portion and a second portion. The first portion extends from a rear end to a coupling end. The second portion extends from a coupling end to a front end. The bow portion comprising a riser assembly, a first limb coupled to the riser assembly, a second limb coupled to the riser assembly, and a drawstring extending from a distal end of the first limb to a distal end of the second limb. The bow portion is coupled to the second portion of the stock. The first portion of the stock is detachably coupled to the second portion of the stock at a coupling location within 6 inches of the drawstring in an undrawn position.

In some embodiments, the bow portion further comprises a power cable extending from the distal end of the first limb to the distal end of the second limb, and the coupling location is rearward from the power cable.

In some embodiments, the coupling location is within 3 inches of the drawstring in an undrawn position.

In some embodiments, the distance from the distal end of the first limb to the distal end of the second limb is within 9 inches of the distance from the rear end of the first portion to the coupling end of the first portion.

In some embodiments, the distance from the distal end of the first limb to the distal end of the second limb is within 5 inches of the distance from the rear end of the first portion to the coupling end of the first portion.

In some embodiments, one of the coupling ends defines a female dovetail coupling and the other coupling end defines a male dovetail coupling.

In some embodiments, the first portion of the stock further comprises a trigger element, and wherein the coupling location is located between the drawstring in an undrawn position and the trigger element.

In some embodiments, a distance from the distal end of the first limb to the distal end of the second limb is greater than or equal to a distance from the coupling end of the second portion to the front end of the second portion.

An embodiment provides a crossbow comprising a stock and a bow portion. The stock comprising a first portion and a second portion. The first portion extends from a rear end to a coupling end and the first portion comprises a trigger element. The second portion extends from a coupling end to front end. The bow portion comprising a riser assembly, a first limb coupled to the riser assembly, a second limb coupled to the riser assembly, a drawstring extending from a distal end of the first limb to a distal end of the second limb, and a power cable extending from the distal end of the first limb to the distal end of the second limb. The bow portion is coupled to the second portion of the stock. The coupling end of first portion of the stock is configured to be detachably coupled to the coupling end of the second portion at a coupling location. When the first portion of the stock is uncoupled from the second portion of the stock the power cables remain in a retained position by the second portion of the stock.

In some embodiments, the distance from the distal end of the first limb to the distal end of the second limb is within 5 inches of the distance from the rear end of the first portion to the coupling end of the first portion.

In some embodiments, one of the coupling ends defines a female dovetail coupling and the other coupling end defines a male dovetail coupling.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present application is defined by the appended claims and their legal equivalents.

BRIEF DESCRIPTION OF THE FIGURES

The technology may be more completely understood in connection with the following drawings, in which.

Figure 1:
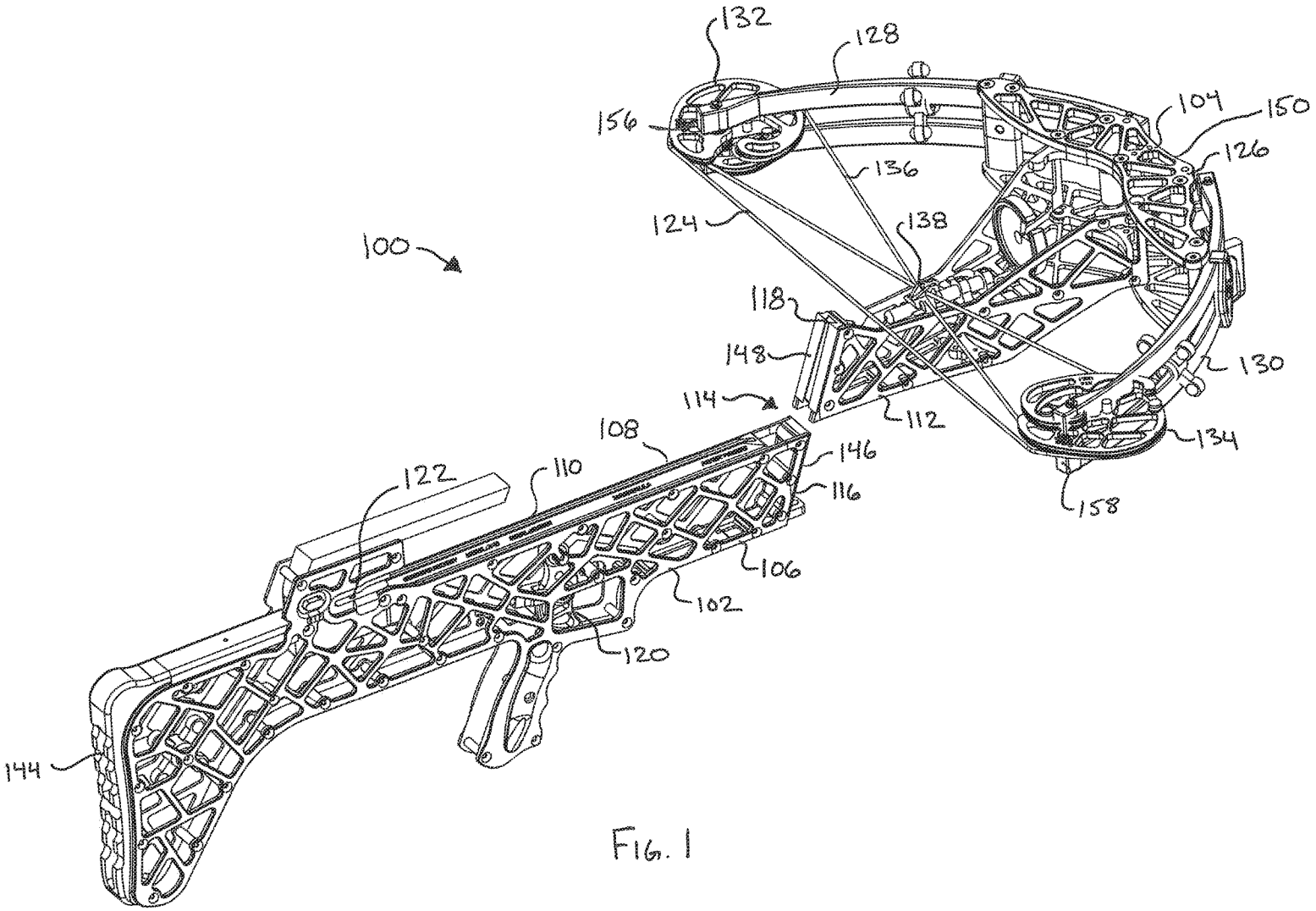
FIG. 1 is a perspective view of a crossbow, according to an embodiment.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The size and configuration of standard crossbows can make them difficult and/or expensive to travel with or ship. Many crossbows include a stock portion and a bow portion. The bow portion can be coupled to the stock portion. Some bows can be configured to remove the bow portion from the stock portion to aid in transport or shipment of the crossbow. In most cases the stock portion is longer and thinner than the bow portion resulting in an inefficient arrangement to transport the two portions together in an uncoupled state. Also, in some examples parts of the bow portion can be linked to parts in the stock portion making uncoupling and re-coupling the stock portion and bow portion difficult and time consuming.

The crossbow described herein comprises a stock portion and a bow portion. The stock portion can include a first stock portion and a second stock portion. The stock portion can be configured in a coupled state or an uncoupled state. In the coupled state the first stock portion is coupled to the second stock portion. In the uncoupled state the first stock portion is not coupled to the second stock portion. The first stock portion can be coupled to the second stock portion to establish the stock. The bow portion can be coupled to the second stock portion. In some embodiments, the bow portion can be permanently coupled to the second stock portion, such that for transport or shipment, the bow portion remains coupled to the second stock portion.

The first stock portion and second stock portion can be temporarily coupled together, such as when the crossbow is in use. The stock portion can be in the uncoupled state when the crossbow is being shipped or transported. The ability to uncouple the first portion of the stock from the second portion of the stock can allow for easier transport and shipment of the crossbow. Further, in some embodiments, power cables included in the bow portion can be retained by a cable guide on the stock portion in a location where the power cables avoid a path of an arrow being shot from the crossbow. When the stock portion is in an uncoupled state the power cables can remain in the retained position by the second stock portion, since the second stock portion can remain coupled to the bow portion in the uncoupled state. The first stock portion can include a trigger element and a string latch for holding and releasing the drawstring to shoot an arrow. The trigger element and the string latch can be in the same configuration regardless of the stock portion being in the coupled state or the uncoupled state.

FIG. 1 shows a perspective view of a crossbow 100, according to an embodiment. The crossbow 100 can include a stock portion 102 and a bow portion 104. In some embodiments, the stock portion 102 can include a first stock plate 106 and a second stock plate 108, such as described in U.S. patent application Ser. No. 15/845,603, filed on Dec. 18, 2017 which is herein incorporated by reference in its entirety. The stock portion 102 can provide a base or structure for coupling to other components of the crossbow 100. In an embodiment, the s stock portion 102 can be coupled to the bow portion 104, such as the bow described in U.S. Pat. No. 9,140,513, which is herein incorporated by reference in its entirety. In other embodiments, the stock portion 102 can be coupled to a compound bow, non-compound bow, a recurve bow or another form of a bow. FIG. 1 shows the crossbow 100 in a horizontal configuration. In a horizontal configuration the bow portion 104 can be perpendicular to the stock portion 102.

The stock portion 102 can include a first stock portion 110 and a second stock portion 112. In an embodiment, the first stock portion 110 and the second stock portion 112 can each include a portion of the first stock plate 106 and a portion of the second stock plate 108. The first stock portion 110 can be coupled to the second stock portion 112 at a coupling location 114. The coupling location 114 can separate the stock portion 102 perpendicular to a longitudinal axis of the stock portion 102.

The first stock portion 110 can extend from a rear end 144 to a coupling end 146. The rear end 144 can be configured to rest against a user's shoulder while using the crossbow 100. The coupling end 146 can be configured to couple the first stock portion 110 to the second stock portion 112. The second stock portion 112 can extend from a coupling end 148 to a front end 150. The coupling end 148 can be configured to be coupled to the first stock portion 110. In some embodiments, the bow portion 104 can be coupled to the second stock portion 112 near the front end 150.

The first stock portion 110 can include a first coupling component 116, such as on the coupling end 146. The second stock portion 112 can include a second coupling component 118, such as on the coupling end 148. The first coupling component 116 and the second coupling component 118 can be configured to mate together to temporarily couple the first stock portion 110 with the second stock portion 112, such as while the crossbow 100 is in use. The first stock portion 110 and the second stock portion 112 can be temporarily coupled, such that the two portions 110, 112 can be uncoupled from each other, such as during transport.

The coupling end 146 of the first stock portion 110 can be detachably coupled to the coupling end 146 of the second stock portion 112. The detachable coupling can be a coupling that can be coupled, uncoupled, and recoupled without any permanent changes to the coupling components 116, 118. In some embodiments, the first stock portion 110 and the second stock portion 112 can be coupled and uncoupled without any tools. In some embodiments, the coupling between the first stock portion 110 and second stock portion 112 can include a latch or other mechanism that a user can operated with his/her hands. In some embodiments, the first stock portion 110 and the second stock portion 112 can be coupled and uncoupled using common tools, such as a screwdriver, wrench, or hex key.

In various embodiments, when the first stock portion 110 and the second stock portion 112 are coupled together the stock portion 102 is rigid, such that the first stock portion 110 and the second stock portion 112 do not rotate, bend or otherwise move relative to each other.

In some embodiments, the first stock portion 110 can be attached or linked to the second stock portion 112 when the coupling end 146 is in the uncoupled arrangement with the coupling end 148, such as by a flexible tether, chain, or other flexible connector. In such an arrangement it should be understood that the while the first stock portion 110 and second stock portion 112 are linked, the stock portion 102 can still be in an uncoupled state. The linking of the first stock portion 110 with the second stock portion 112, such as by a tether, can be to ensure that one of the two stock portions 110, 112 is not lost during transportation of the crossbow 100.

The first stock portion 110 can include a trigger element 120 and a string latch 122. The string latch 122 can be configured to retain or hold the drawstring 124 in a drawn position. The string latch 122 can be configured as a release element, such that it can retain and release the drawstring and/or an arrow. The string latch 122 can be linked to the trigger element 120, such that when the user activates the trigger element 120, such as by pulling, the drawstring 124 is released from the string latch 122 resulting in shooting an arrow from the crossbow 100. In some embodiments, the coupling location 114 can be located between the string latch 122 and the drawstring 124 in an undrawn position. In some embodiments, the coupling location 114 can be located between the trigger element 120 and the drawstring 124 in an undrawn position.

The bow portion 104 can include a riser assembly 126. The riser assembly 126 can be coupled to two limbs 128, 130. The drawstring 124 can extend from the distal end 156 of the first limb 128 to the distal end 158 of the second limb 130. In some embodiments, a pulley 132, 134 can be disposed at the distal ends of the limbs 128, 130. One or more power cables 136 can extend between the first pulley 132 and the second pulley 134. A cable guide 138 can retain or hold the power cables 136 in a position below or out of the path of an arrow being shot from the crossbow 100. In some embodiments, the cable guide 138 holds the power cables 136 in side tension. In some embodiments, the cable guide 138 is located on the second stock portion and holds the power cables 136 in side tension whether the first stock portion is coupled or uncoupled from the second stock portion.

Figure 2:
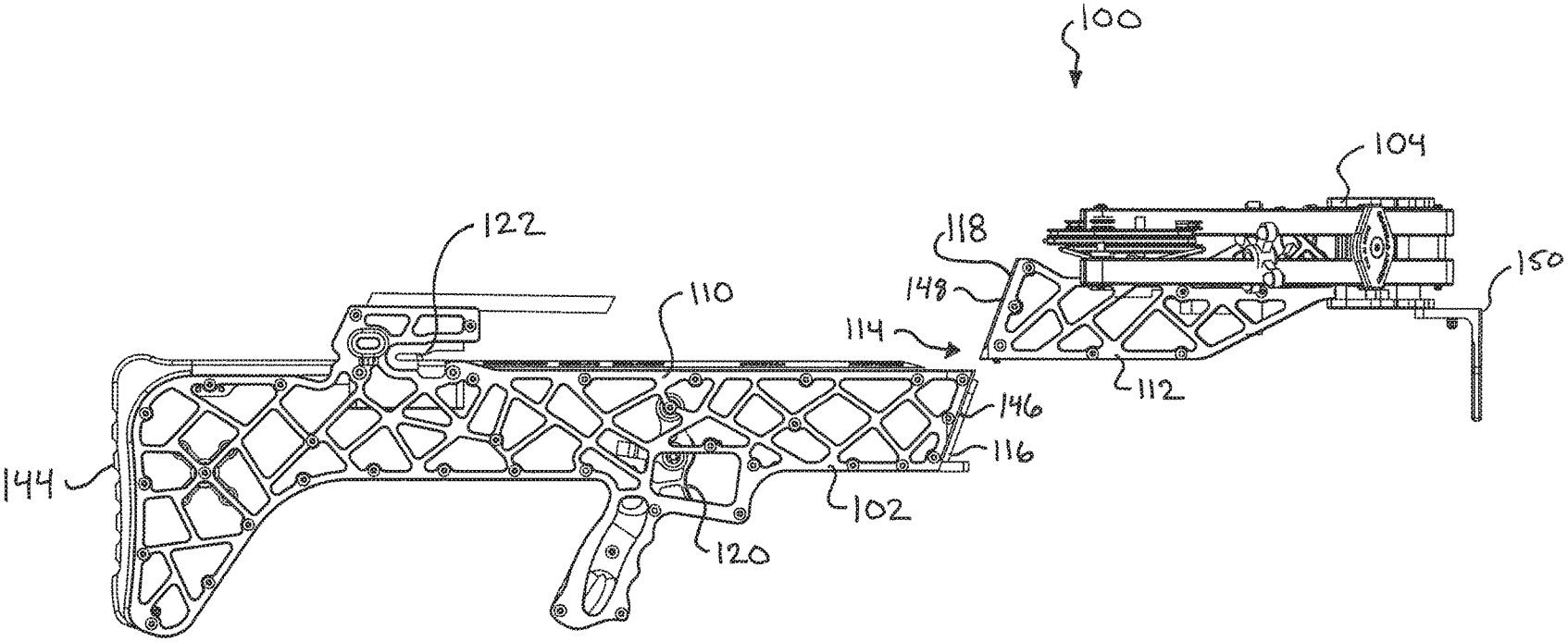
FIG. 2 is a side view of the crossbow shown in FIG. 1.

FIG. 2 shows a side view of the crossbow 100 shown in FIG. 1. In some embodiments, the first stock portion 110 and the second stock portion 112 can be uncoupled from each other by sliding one of the stock portions 110, 112 away from the other stock portion 110, 112. In one embodiment, the stock portions 110, 112 move away from each other in a direction that is not parallel to a longitudinal axis of the stock portion 102. In one embodiment, the stock portions 110, 112 move away from each other in a direction that is not perpendicular to the longitudinal axis of the stock portion 102. In one embodiment, the stock portions 110, 112 move away from each other in a direction that is substantially perpendicular to the longitudinal axis of the stock portion 102. In various embodiments, the coupling location 114 can be located near or adjacent to a plane perpendicular to a longitudinal axis of the stock portion 102 that includes the drawstring 124 in an undrawn position as shown in the figures. In some embodiments, the coupling location 114 can be located within 3 inches of the drawstring 124 in an undrawn position. In some embodiments, the coupling location 114 can be located within 6 inches of the drawstring 124 in an undrawn position. In some embodiments, the coupling location 114 can be located rearward of the drawstring 124 in an undrawn position. In some embodiments, the coupling location 114 can be located rearward of the power cables 136. In some embodiments, the coupling location 114 can be located in front of the trigger element 120. In some embodiments, the coupling location 114 can be located between the drawstring 124 in an undrawn position and the trigger element 120. In some embodiments, the coupling location 114 can be located between the power cables 136 and the trigger element 120.

Figure 3:
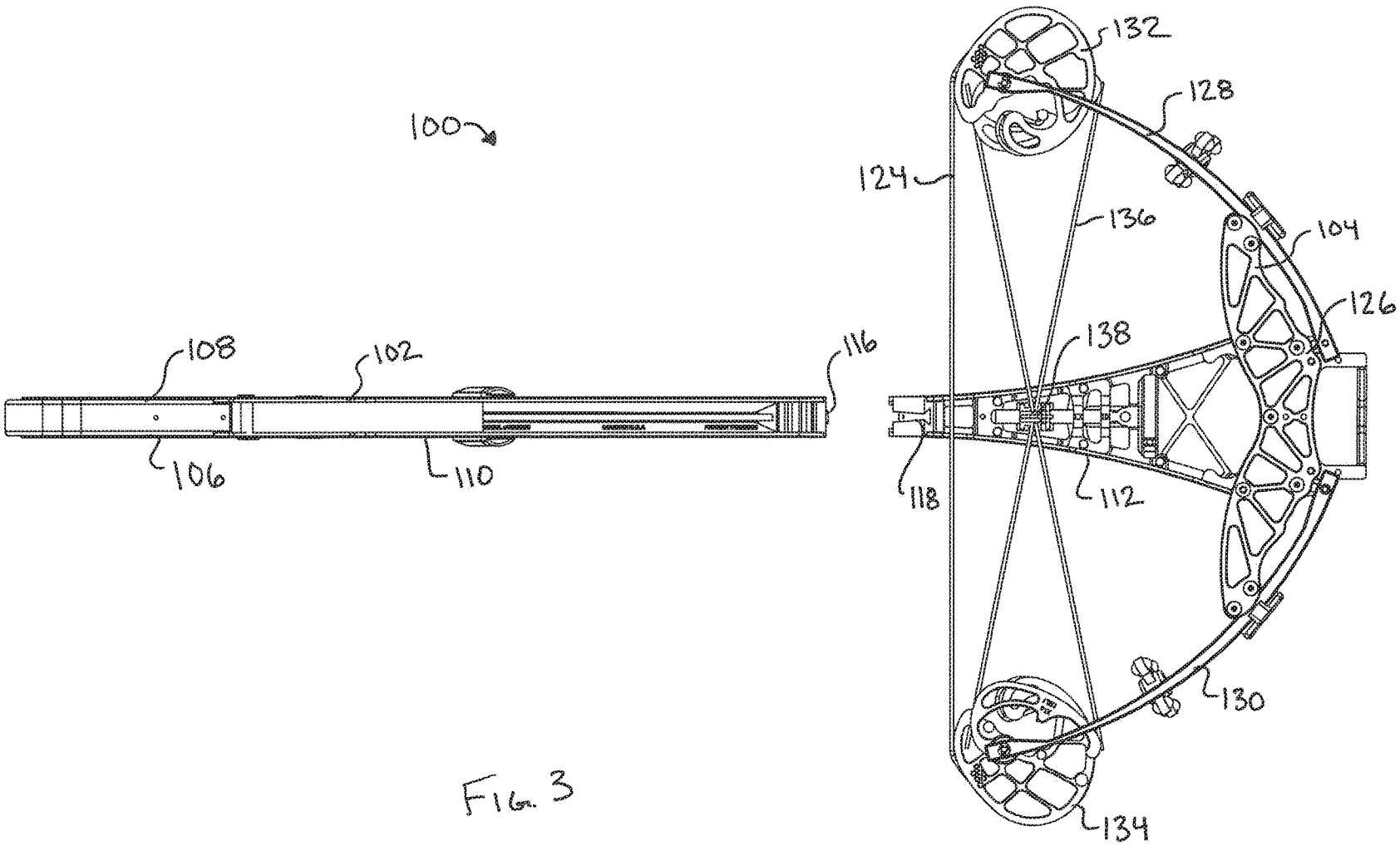
FIG. 3 is a top view of the crossbow shown in FIG. 1.

FIG. 3 is a top view of the crossbow shown in FIG. 1. In various embodiments, the power cables 136 remain in the same retained position by the cable guide 138 regardless of whether the stock portion 102 is in the coupled state or the uncoupled state. In various embodiments, the coupling location 114 is located between the bow portion 104 and the string latch 122. The elements involved in releasing the drawstring (trigger element and string latch) are not disrupted in the conversion between the coupled state to the uncoupled state, or from the uncoupled state to the coupled state. Similarly, the components of the bow portion (limbs, drawstring, power cables, and cable guide) are also not disrupted in the conversion between the coupled state to the uncoupled state, or from the uncoupled state to the coupled state. The position of the power cables relative to the second stock portion 112 can remain constant in the conversion between the coupled state to the uncoupled state, or from the uncoupled state to the coupled state.

Figure 4:
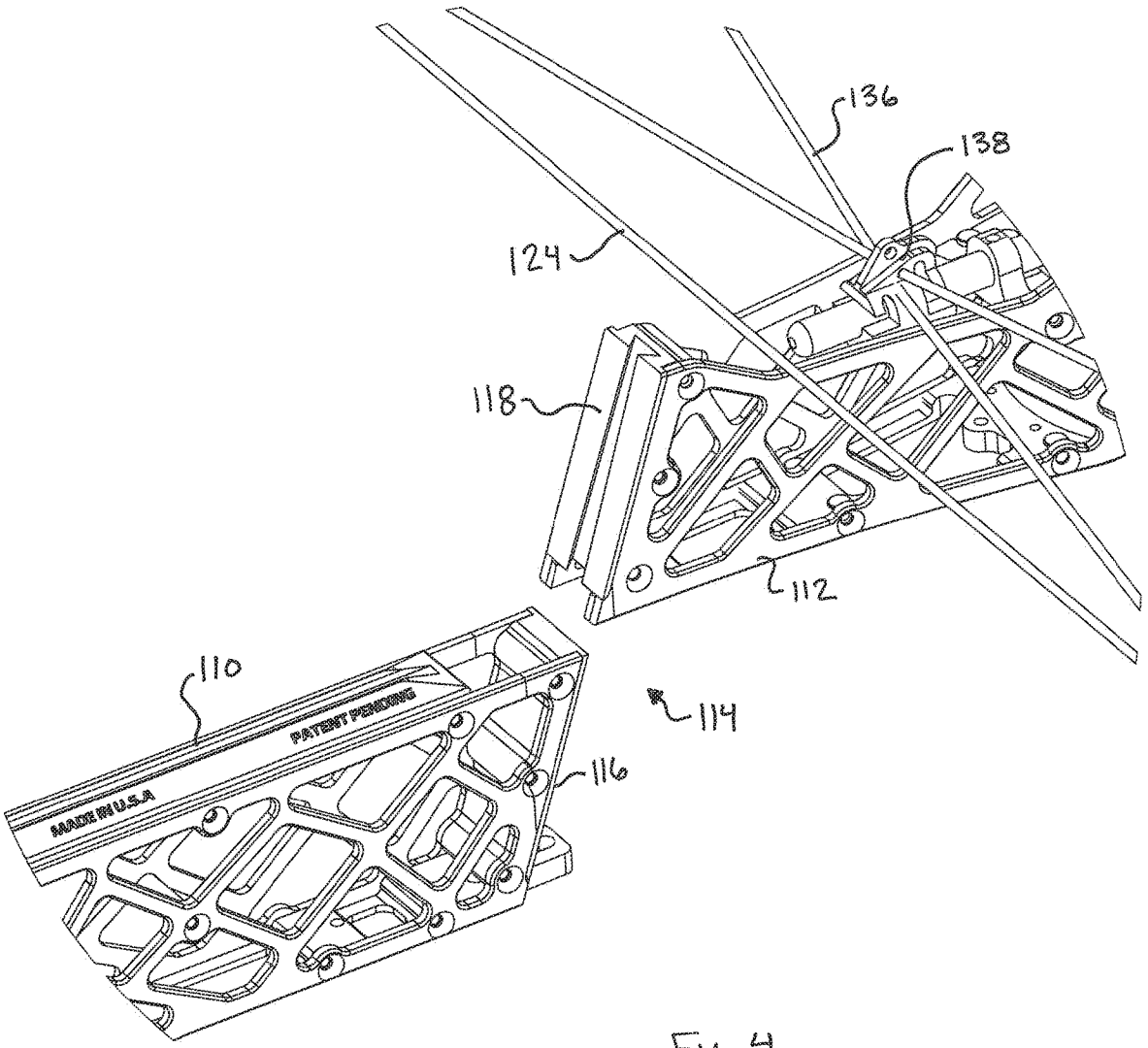
FIG. 4 is a close up view of the coupling location shown in FIG. 1.

FIG. 4 shows a close up view of the coupling location shown in FIG. 1 with the stock portion in an uncoupled state. In some embodiments, the first coupling component 116 and the second coupling component 118 can form a dovetail coupling, such that one of the components 116, 118 forms a male dovetail and the other coupling component 116, 118 forms a female dovetail. In various embodiments, one of the coupling ends 146, 148 can define a male dovetail and the other coupling end 146, 148 can define a female dovetail. The figures show the coupling end 146 on the first stock portion 110 as the male dovetail coupling and the coupling end 148 on the second stock portion 112 as the female dovetail. In some embodiments, the dovetail coupling can be tapered, such that the coupling increases in tightness or strength as the two coupling components 116, 118 are coupled together. In other embodiments, the first coupling component 116 and the second coupling component 118 can form a butt joint or a pin joint.

Figure 5:
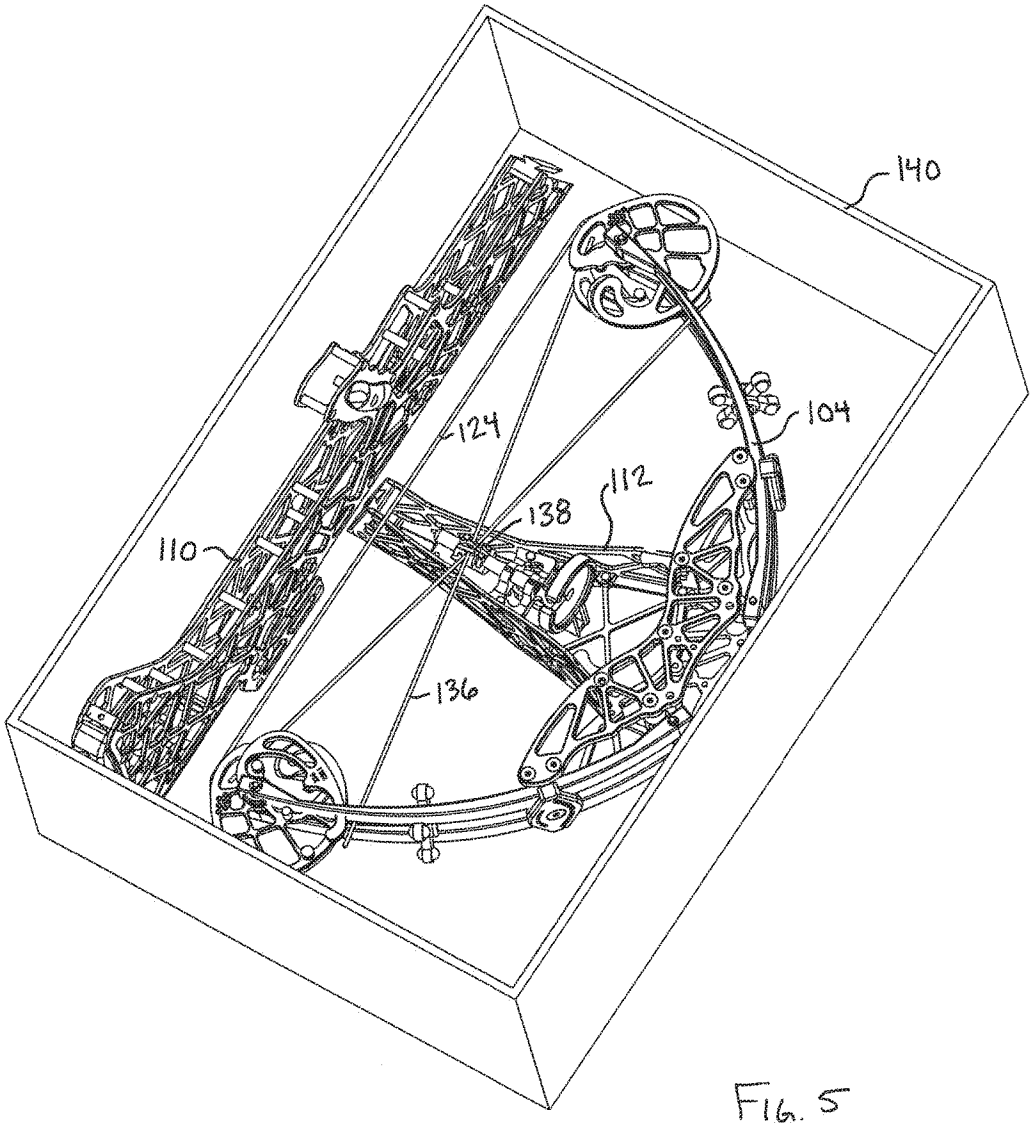
FIG. 5 is a perspective view of a crossbow in an uncoupled state in a transport container, according to an embodiment.
Figure 6:
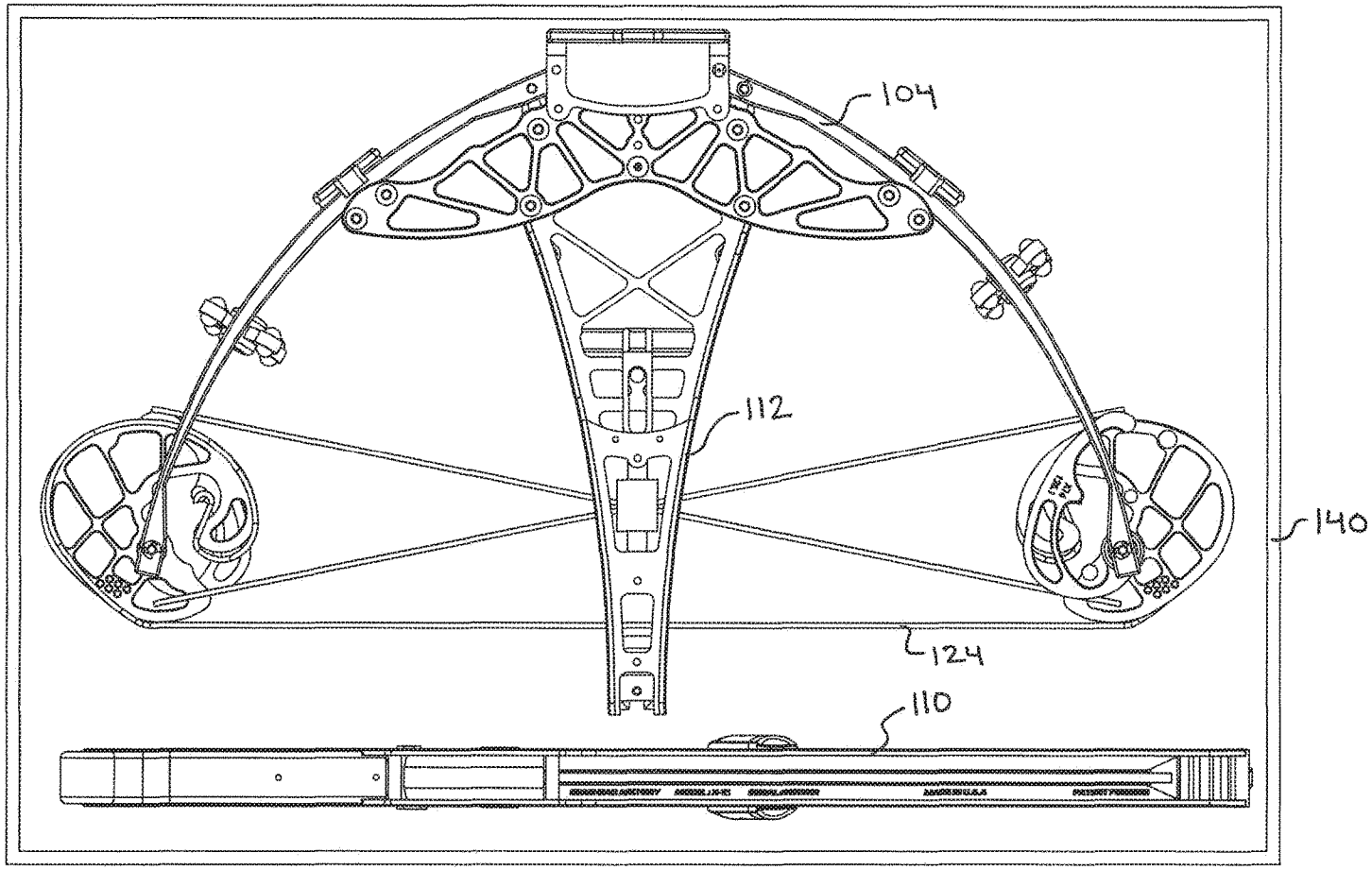
FIG. 6 is a top view of the crossbow in a transport container shown in FIG. 5.

FIG. 5 shows a perspective view of a crossbow 100 in an uncoupled state in a transport container 1, according to an embodiment. FIG. 6 shows a top view of the crossbow 100 in a transport container 140 shown in FIG. 5. In some embodiments, the distance between the first pulley 132 and the second pulley 134 can be larger or equal to the length of the second stock portion 112.

In various embodiments, the distance from the distal end 156 of the first limb 128 to the distal end 158 of the second limb 130 is within 12 inches of the distance from the rear end 144 to the coupling end 146 of the first stock portion 110. In various embodiments, the distance from the distal end 156 of the first limb 128 to the distal end 158 of the second limb 130 is within 10 inches of the distance from the rear end 144 to the coupling end 146 of the first stock portion 110. In various embodiments, the distance from the distal end 156 of the first limb 128 to the distal end 158 of the second limb 130 is within 9 inches of the distance from the rear end 144 to the coupling end 146 of the first stock portion 110. In various embodiments, the distance from the distal end 156 of the first limb 128 to the distal end 158 of the second limb 130 is within 8 inches of the distance from the rear end 144 to the coupling end 146 of the first stock portion 110. In various embodiments, the distance from the distal end 156 of the first limb 128 to the distal end 158 of the second limb 130 is within 7 inches of the distance from the rear end 144 to the coupling end 146 of the first stock portion 110. In various embodiments, the distance from the distal end 156 of the first limb 128 to the distal end 158 of the second limb 130 is within 6 inches of the distance from the rear end 144 to the coupling end 146 of the first stock portion 110. In various embodiments, the distance from the distal end 156 of the first limb 128 to the distal end 158 of the second limb 130 is within 5 inches of the distance from the rear end 144 to the coupling end 146 of the first stock portion 110. In various embodiments, the distance from the distal end 156 of the first limb 128 to the distal end 158 of the second limb 130 is within 4 inches of the distance from the rear end 144 to the coupling end 146 of the first stock portion 110. In various embodiments, the distance from the distal end 156 of the first limb 128 to the distal end 158 of the second limb 130 is within 3 inches of the distance from the rear end 144 to the coupling end 146 of the first stock portion 110. In various embodiments, the distance from the distal end 156 of the first limb 128 to the distal end 158 of the second limb 130 is within 2 inches of the distance from the rear end 144 to the coupling end 146 of the first stock portion 110.

In various embodiments, the width of the bow portion 104, such as from the outer most part of the first pulley 132 (when the drawstring is in an undrawn position) to the outer most part of the second pulley 134 (when the drawstring is in an undrawn position), can be within 6 inches of the distance from the rear end 144 to the coupling end 146 of the first stock portion 110, such that the width of the bow portion 104 can be 6 or less inches longer or shorter than the length of the first stock portion 110. In various embodiments, the width of the bow portion 104 can be within 5 inches of the distance from the rear end 144 to the coupling end 146 of the first stock portion 110. In various embodiments, the width of the bow portion 104 can be within 4 inches of the distance from the rear end 144 to the coupling end 146 of the first stock portion 110. In various embodiments, the width of the bow portion 104 can be within 3 inches of the distance from the rear end 144 to the coupling end 146 of the first stock portion 110. In various embodiments, the width of the bow portion 104 can be within 2 inches of the distance from the rear end 144 to the coupling end 146 of the first stock portion 110.

In various embodiments, the width of the bow portion 104, such as from the first pulley 132 to the second pulley 134, is within 6 inches of the distance from the rear end 144 to the coupling end 146 of the first stock portion 110. In other embodiments, the width of the bow portion 104 is within 5 inches, 4 inches, 3 inches, or 2 inches of the distance from the rear end 144 to the coupling end 146 of the first stock portion 110.

In some embodiments, the distance from the distal end 156 of the first limb 128 to the distal end 158 of the second limb 130 is greater than or equal to the distance from the coupling end 148 of the second stock portion 112 to the front end 150 of the second stock portion 112.

In an embodiment, the crossbow 100 in the uncoupled state can be disposed within a transport container 140. In some embodiments, the first stock portion 110 can be substantially parallel with the drawstring 124. In various embodiments, the second stock portion 112 can extend from the riser assembly 126 past the drawstring 124, such as when the coupling location 114 is located between the drawstring 124 and the trigger element 120.

A further embodiment includes a method of using a crossbow. In an embodiment, the method can include coupling a first stock portion to a second stock portion. The first stock portion can include a string latch or trigger element. The second stock portion can be coupled to or include a bow portion. In an embodiment, the method can include uncoupling a first stock portion from a second stock portion, such as to arrange the two stock portion into a transport container for transporting the crossbow.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference. The publications and patents disclosed herein are provided solely for their disclosure. Nothing herein is to be construed as an admission that the inventors are not entitled to antedate any publication and/or patent, including any publication and/or patent cited herein.

The technology has been described with reference to various specific and preferred embodiments and techniques. However, it should be understood that many variations and modifications may be made while remaining within the spirit and scope of the technology.

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

The invention claimed is:

1. A crossbow, comprising:

a stock, the stock comprising a first portion and a second portion, wherein the first portion comprises a string latch and the first portion extends from a rear end to a coupling end, and the second portion extends from a coupling end to a front end; and a bow portion, comprising:

a riser assembly;

a first limb coupled to the riser assembly;

a second limb coupled to the riser assembly; and a drawstring extending from a distal end of the first limb to a distal end of the second limb;

wherein the bow portion is coupled to the second portion of the stock;

wherein the coupling end of the first portion of the stock is detachably coupled to the coupling end of the second portion of the stock at a coupling location, wherein the coupling location is between the string latch and the drawstring in an undrawn position.

2. The crossbow according to claim 1, wherein the first portion further comprises a trigger element between the string latch and the drawstring in an undrawn position and wherein the coupling location is between the trigger element and the drawstring in an undrawn position.

3. The crossbow according to claim 1, wherein the distance from the distal end of the first limb to the distal end of the second limb is within 9 inches of the distance from the rear end of the first portion to the coupling end of the first portion.

4. The crossbow according to claim 3, wherein the distance from the distal end of the first limb to the distal end of the second limb is within 5 inches of the distance from the rear end of the first portion to the coupling end of the first portion.

5. The crossbow according to claim 3, wherein the distance from the distal end of the first limb to the distal end of the second limb is greater than or equal to the distance from the coupling end of the second portion to the front end of the second portion.

6. The crossbow according to claim 1, wherein one of the coupling ends defines a female dovetail coupling and the other coupling end defines a male dovetail coupling.

7. The crossbow according to claim 1, wherein the bow portion further comprises a power cable extending from the distal end of the first limb to the distal end of the second limb; and the power cable is retained by the second portion of the stock.

8. The crossbow according to claim 1, wherein the bow portion is arranged on the stock in a horizontal configuration.

9. The crossbow according to claim 1, wherein the stock comprises two parallel plates defining a gap.

10. A crossbow, comprising:

a stock, the stock comprising a first portion and a second portion, wherein the first portion extends from a rear end to a coupling end and the second portion extends from a coupling end to a front end; and a bow portion, comprising:

a riser assembly;

a first limb coupled to the riser assembly;

a second limb coupled to the riser assembly; and a drawstring extending from a distal end of the first limb to a distal end of the second limb;

wherein the bow portion is coupled to the second portion of the stock;

wherein the first portion of the stock is detachably coupled to the second portion of the stock at a coupling location within 6 inches of the drawstring in an undrawn position.

11. The crossbow according to claim 10, wherein the bow portion further comprises a power cable extending from the distal end of the first limb to the distal end of the second limb;

wherein the coupling location is rearward from the power cable.

12. The crossbow according to claim 10, wherein the coupling location is within 3 inches of the drawstring in an undrawn position.

13. The crossbow according to claim 10, wherein the distance from the distal end of the first limb to the distal end of the second limb is within 9 inches of the distance from the rear end of the first portion to the coupling end of the first portion.

14. The crossbow according to claim 10, wherein the distance from the distal end of the first limb to the distal end of the second limb is within 5 inches of the distance from the rear end of the first portion to the coupling end of the first portion.

15. The crossbow according to claim 10, wherein one of the coupling ends defines a female dovetail coupling and the other coupling end defines a male dovetail coupling.

16. The crossbow according to claim 10, wherein the first portion of the stock further comprises a trigger element, and wherein the coupling location is located between the drawstring in an undrawn position and the trigger element.

17. The crossbow according to claim 10, wherein a distance from the distal end of the first limb to the distal end of the second limb is greater than or equal to a distance from the coupling end of the second portion to the front end of the second portion.

18. A crossbow, comprising:

a stock, the stock comprising a first portion and a second portion, wherein the first portion extends from a rear end to a coupling end and the first portion comprises a trigger element, the second portion extends from a coupling end to front end; and a bow portion, comprising:

a riser assembly;

a first limb coupled to the riser assembly;

a second limb coupled to the riser assembly;

a drawstring extending from a distal end of the first limb to a distal end of the second limb; and a power cable extending from the distal end of the first limb to the distal end of the second limb;

wherein the bow portion is coupled to the second portion of the stock;

wherein the coupling end of first portion of the stock is configured to be detachably coupled to the coupling end of the second portion at a coupling location;

wherein when the first portion of the stock is uncoupled from the second portion of the stock the power cables remain in a retained position by the second portion of the stock.

19. The crossbow according to claim 18, wherein the distance from the distal end of the first limb to the distal end of the second limb is within 5 inches of the distance from the rear end of the first portion to the coupling end of the first portion.

20. The crossbow according to claim 18, wherein one of the coupling ends defines a female dovetail coupling and the other coupling end defines a male dovetail coupling.

* * * * *